US007926420B2

(12) United States Patent
Kübert et al.

(10) Patent No.: US 7,926,420 B2
(45) Date of Patent: Apr. 19, 2011

(54) PRINTING UNIT HAVING AT LEAST TWO LATERAL FRAME PARTS THE DISTANCE OF WHICH CAN BE CHANGED RELATIVE TO EACH OTHER IN A HORIZONTAL DIRECTION

(75) Inventors: Thomas Kübert, Karlstadt (DE); Bernd Kurt Masuch, Kürnach (DE)

(73) Assignee: Koenig & Bauer Atkiengesellschaft, Wurzburg (DE)

( * ) Notice: Subject to any disclaimer, the term of this patent is extended or adjusted under 35 U.S.C. 154(b) by 0 days.

(21) Appl. No.: 12/734,092

(22) PCT Filed: Jul. 11, 2008

(86) PCT No.: PCT/EP2008/059073

§ 371 (c)(1),
(2), (4) Date: Jun. 21, 2010

(87) PCT Pub. No.: WO2009/049936

PCT Pub. Date: Apr. 23, 2009

(65) Prior Publication Data

US 2010/0263564 A1 Oct. 21, 2010

(30) Foreign Application Priority Data

Oct. 12, 2007 (DE) ..... 10 2007 000 863

(51) Int. Cl.
*B41F 5/16* (2006.01)

(52) U.S. Cl. ..... 101/183; 101/216

(58) Field of Classification Search ..... 101/183
See application file for complete search history.

(56) References Cited

U.S. PATENT DOCUMENTS 3,835,776 A * 9/1974 Weidman ..... 101/183
4,007,983 A * 2/1977 Knieser ..... 399/348
4,080,009 A * 3/1978 Marathe et al. ..... 384/12
4,087,191 A * 5/1978 Brady et al. ..... 404/69
5,640,906 A * 6/1997 Schmitt ..... 101/177

(Continued)

FOREIGN PATENT DOCUMENTS

DE 100 17 507 10/2001

(Continued)

OTHER PUBLICATIONS

Wolf Kunststoff-Gleitlager GmbH, "Halbzeuge aus ZEDEX 100," www.plasticbearings.com, pp. 1-11.

(Continued)

*Primary Examiner* — Anthony H. Nguyen
(74) *Attorney, Agent, or Firm* — Jones, Tullar & Cooper, P.C.

(57) ABSTRACT

A printing unit has at least two lateral frame parts. The distance between which can be changed, relative to each other, in a horizontal direction. Each frame part receives a printing group or parts of such a printing group. At least one of the lateral frame parts is displaceably supported for movement between a functional position, in which the lateral frame parts meet and are affixed relative to one another, and an open position in which the lateral frame parts are positioned at a distance from each other. The support of the at least one movable lateral frame part has at least one sliding surface which is made using a composite plastic that is composed of multiple materials.

43 Claims, 15 Drawing Sheets

U.S. PATENT DOCUMENTS

| | | | | |
|---|---|---|---|---|
| 5,782,182 | A | 7/1998 | Ruckmann et al. | |
| 6,467,408 | B1 * | 10/2002 | Hillebrand | 101/217 |
| 6,786,151 | B2 * | 9/2004 | Stiel | 101/335 |
| 2001/0037743 | A1 | 11/2001 | Takahashi | |
| 2005/0000376 | A1 | 1/2005 | Kolbe et al. | |
| 2006/0148393 | A1 * | 7/2006 | Ono et al. | 451/526 |
| 2007/0137510 | A1 | 6/2007 | Schneider et al. | |
| 2007/0144387 | A1 | 6/2007 | Schneider et al. | |

FOREIGN PATENT DOCUMENTS

| | | |
|---|---|---|
| DE | 601 18 828 | 9/2006 |
| EP | 0 749 369 | 12/1996 |
| EP | 1 149 694 | 10/2001 |
| EP | 1 500 500 | 1/2005 |
| EP | 1 767 359 | 3/2007 |
| WO | WO 2005/037552 | 4/2005 |
| WO | WO 2005/037553 | 4/2005 |

OTHER PUBLICATIONS

Wolf Kunststoff-Gleitlager GmbH, "ZEDEX 100 und die Tribologie," www.plasticbearings.com, pp. 1-2 and 15-23.

* cited by examiner

PRINTING UNIT HAVING AT LEAST TWO LATERAL FRAME PARTS THE DISTANCE OF WHICH CAN BE CHANGED RELATIVE TO EACH OTHER IN A HORIZONTAL DIRECTION

CROSS-REFERENCE TO RELATED APPLICATIONS

This application is the U.S. national phase, under 35 U.S.C. 371, of PCT/EP 2008/059073, filed Jul. 11, 2008, published as WO 2009/049936 A1 on Apr. 23, 2009, and claiming priority to DE 10 2007 000 863.7, filed Oct. 12, 2007, the disclosures of which are expressly incorporated herein by reference.

FIELD OF THE INVENTION

The present invention is directed to a printing unit comprising at least two side frame parts whose distance relative to one another can be modified in a horizontal direction. Each of the side frame parts accommodates at least one printing couple or parts of a printing couple. At least one of the side frame parts can be moved between a closed functional position and the open position. The mounting of the at least one movable side frame part has at least one sliding surface made of plastic.

BACKGROUND OF THE INVENTION

A printing unit, which is embodied as a printing tower with four blanket-to-blanket printing units or arch-type printing units arranged one above the other, is known from WO 2005/037553 A1. This printing unit comprises two frame parts that are movable relative to one another, each with two side frame plates arranged opposite one another. Three centering or locking devices, which may be embodied as hooks, are assigned to each side frame plate further printing unit, which is embodied as a printing tower with four blanket-to-blanket printing units or arch-type printing units arranged one above the other, is known from WO 2005/037552 A1. A frame part that is movable relative to a stationary frame part is mounted on rollers. The rollers can be moved into a retracted position. This will allow the weight of the movable frame part to be supported against a stationary base.

A further printing unit, which is also embodied as a printing tower with four blanket-to-blanket printing units or with four arch-type printing units arranged one above the other, is known from EP 07 49 369 B1. This printing unit is provided with a stationary frame part and with a movable frame part, which is mounted on rollers. Two frame parts can be locked in the operating position.

A further printing unit, that may also be embodied as a printing tower, with four blanket-to-blanket printing units arranged one above the other, is known from EP 17 67 359 A2. The frame parts, that are movable relative to one another, are provided. The printing couple cylinders of the blanket-to-blanket printing units are mounted in hydraulically actuable linear bearings so as to be displaceable radially.

DE 601 18 827 T2 discloses a printing unit which is provided with separable side parts. The separable side parts are mounted on blocks that are equipped with a motive material.

The firm brochures "Semifinished Products made from ZEDEX 100," (front page, pages 3 through 11) and "ZEDEX 100 and Tribology" (front page, pages 15 through 23) describe the material properties of a composite plastic. The brochures do not contain any reference to the use of such a composite plastic material in printing presses.

SUMMARY OF THE INVENTION

The object of the present invention is to provide a printing unit comprising at least two side frame parts whose distance relative to one another can be modified in a horizontal direction.

The object is attained in accordance with the present invention by the provision of at least two frame parts whose distance relative to each other can be modified in a horizontal direction. Each of the side frame parts can accommodate at least one printing couple or parts of a printing couple. At least one of these side frame parts can be moved, with respect to the other side frame part, between a closed, functional position, in which the side parts are moving together and fixed in relation to each other, and an open position in which they are spaced from one another. The mounting of the at least one movable side frame part has at least one sliding surface which is made of a composite plastic comprised of multiple materials.

Good antifrictional properties, with low wear and tear, can be achieved by using a composite plastic. The low wear and tear can preferably be improved even further by depressions in the plastic, which depressions are capable of removing soiling. The special selection of the composite plastic makes it possible to use simple plain bearings to mount positionable side frames for large newspaper printing presses, for example.

The cylinder/piston assembly, which is provided in accordance with the preferred embodiment of the present invention and which, in particular, is centered or, for example, is positioned at the load center or near the load center, and in the underframe of the printing unit. This assembly thereby supports a precise positioning of the movable side frame part during operation.

BRIEF DESCRIPTION OF THE DRAWINGS

Preferred embodiments of the present invention are shown in the set of drawings and will be specified in greater detail in what follows.

In the drawings.

DESCRIPTION OF THE PREFERRED EMBODIMENTS

Figure 1:
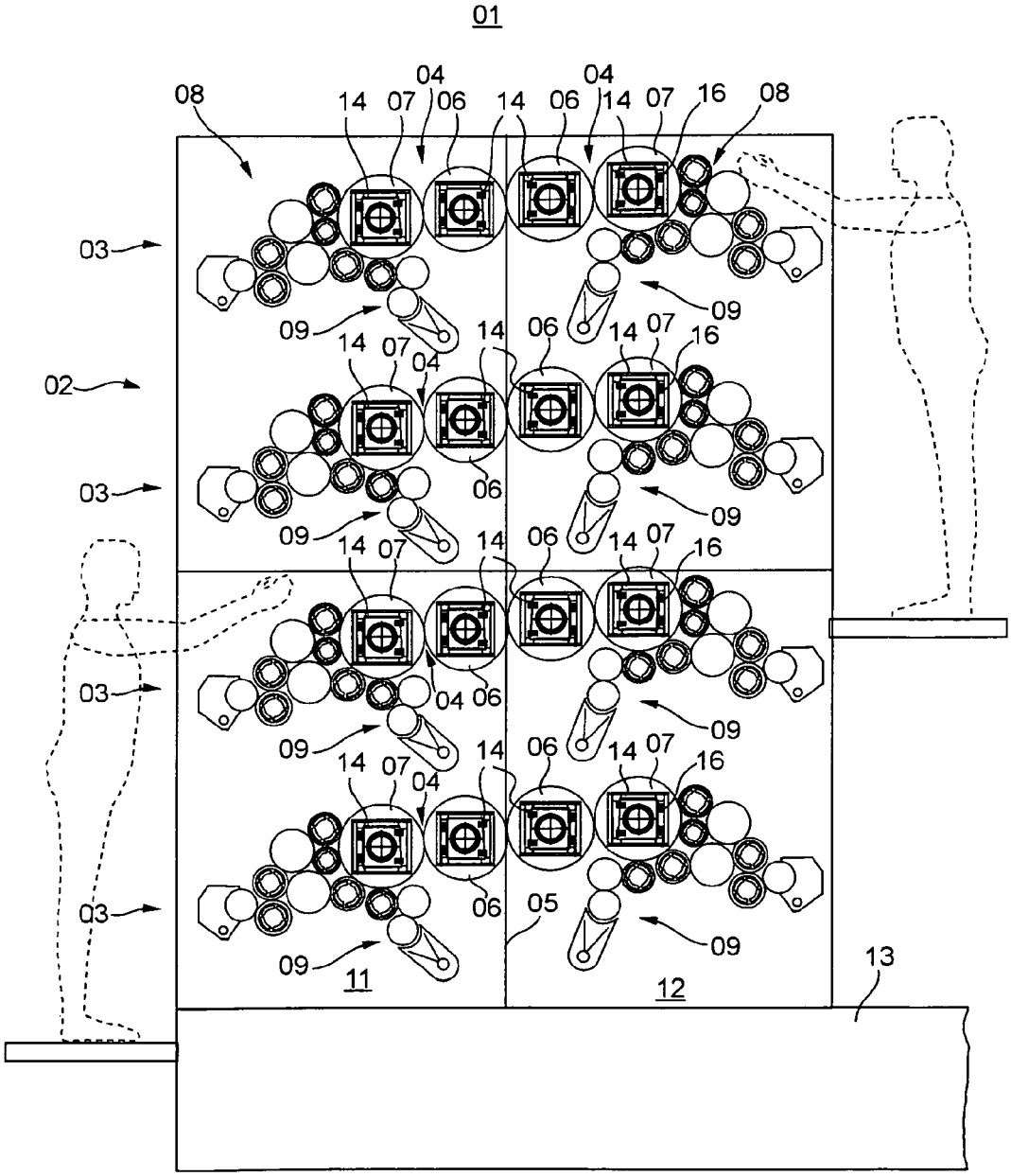
FIG. 1 is a schematic side elevation view of a printing unit with one stationary side frame part and one moveable side frame part whose spacing from the stationary side frame part is variable.

FIG. 1 shows a highly simplified, schematic side elevation view of a printing unit 01 or printing press 01, and in particular, depicts a web-fed rotary printing press 01 in the form of a printing tower 01, which preferably is a printing press 01 that prints in multiple different colors. Printing unit 01 is comprised, for example, of four printing couples 04, namely blanket-to-blanket printing units 03, which are arranged vertically, one above the other, in a frame 02. A print substrate 05, such as, for example, a web of material 05, and especially a paper web 05, passes through the blanket-to-blanket printing units 03 in succession in a vertical direction. Each of these blanket-to-blanket printing units 03 is comprised of two printing couples 04.

In the printing unit 01 shown in FIG. 1, in each blanket-to-blanket printing unit 03, one printing couple 04 and comprising a first cylinder 06 or printing couple cylinder 06, and in particular, a transfer cylinder 06 or a blanket cylinder 06, which transfers printing ink and is which loaded with at least one blanket, and a second cylinder 07 or printing couple cylinder 07, and in particular, a forme cylinder 07 or a plate cylinder 07, which rolls against the blanket cylinder 06 and which holds one or more printing plates, are positioned on each of the two sides of the paper web 05 for accomplishing straight and verso printing. The two blanket cylinders 06 and the two plate cylinders 07 of two opposite printing couples 04 of a blanket-to-blanket printing unit 03 are arranged such that their rotational axes lie within a plane which is inclined by preferably 75° to 88° in relation to the paper web 05.

An inking unit 08, such as, for example, a roller inking unit 08 or an anilox inking unit 08, is assigned to each printing couple 04 which is comprised of at least a blanket cylinder 06 and a plate cylinder 07. Also assigned to each printing couple 04 is a dampening unit 09, such as, for example, a spray dampening unit 09. If printing will be performed in "dry offset" or "waterless offset printing," in a manner which is not specified in greater detail, no dampening agent, and thus no dampening unit 09, is provided. In this situation, the inking unit 08 can be embodied, for example, as an ink pump unit 08.

Each printing couple 04 of the printing press 01 has at least one preferably position-controlled drive motor, which will not be specified in greater detail here. The plate cylinder 07 and the blanket cylinder 06 can be connected to one another, particularly in terms of their drive mechanism, by the use of toothed gears. Alternatively, each blanket cylinder 06 and each plate cylinder 07 can be equipped with its own drive motor, which is not specified in greater detail here. With a drive mechanism of this type, a plate change can be performed on one plate cylinder 07 independently of the performance of a plate change on another plate cylinder 07.

The printing couples 04, or their plate cylinders 07, can be configured to accommodate multiple printing plates in an axial direction. In particular, 2, 3, 4, 5, 6, 7, or 8 printing plates can be accommodated in the axial direction. The plate cylinders 07 can be configured to accommodate one or, if applicable, to accommodate multiple printing plates in the circumferential direction, and in particular, to accommodate two printing plates in the circumferential direction.

In the representation of FIG. 1, the blanket cylinders 06 which are positioned on both sides of the paper web 05, and each in a respective blanket-to-blanket printing unit 03, are engaged against one another in a so-called blanket-to-blanket configuration. The blanket cylinders 06 which are engaged against one another, function alternatively as impression cylinders. Alternatively, printing couples 04 can be combined in a manner which is not specified in greater detail, to form a satellite printing unit. In each such satellite printing unit, four printing couples 04 are arranged around a shared impression cylinder which is separate from the other cylinders 06; 07. The paper web 05 in each case is guided between at least one transfer cylinder 06, that is engaged against the impression cylinder and the impression cylinder.

As is depicted in FIG. 1, the printing tower 01 comprises multiple, and in particular, comprises two separable side frame modules 11; 12 or side frame parts 11; 12 whose distance in relation to one another can be modified in the horizontal direction. In particular, the printing tower 01 utilizes one side frame part 11 which is stationary in the press or in its location, and one side frame part 12 which is displaceable in relation to the first. The displaceable side frame part 12 is displaceable along a stationary base 13 beneath it. Alternatively, both side frame parts 11; 12 can also be displaceably arranged. A printing couple 04 of a blanket-to-blanket printing unit 03, including the associated components, such as inking unit 08 and, if applicable, dampening unit 09, and optionally also including automatic or semiautomatic plate changing devices or plate magazines, which are not specifically shown here, are arranged in each side frame part 11; 12. The separability of the frame 02 allows the frame 02 to be opened, which frame opening allows optimum access to corresponding printing couple components for set-up, maintenance and, if necessary, also for repairs.

The printing couple cylinders 06; 07, such as, for example, the transfer cylinder 06 or the blanket cylinder 06 and the forme cylinder 07 or the plate cylinder 07, are each mounted in a bearing unit 14 or in a linear bearing 14. Preferably, both ends of each printing couple cylinder 06; 07 are mounted in a linear bearing 14. A linear bearing 14 of this type supports a printing couple cylinder 06; 07 to allow rotation, while at the same time permitting translational movement. In other words, the linear bearing 14 provides a linear adjustment path for the printing couple cylinder 06; 07, for example, for disengaging the plate cylinder 07 from the blanket cylinder 06 for the purpose of a plate change, for example. The linear bearings 14 are movable by the operation of actuators 16, typically in the form of hydraulic pistons 16, which have a shared hydraulic fluid supply that is not illustrated in greater detail here. For a description of the structure and the functioning of the known linear bearings 14, refer, for example, to the previously cited EP 17 67 359 A2.

Figure 2:
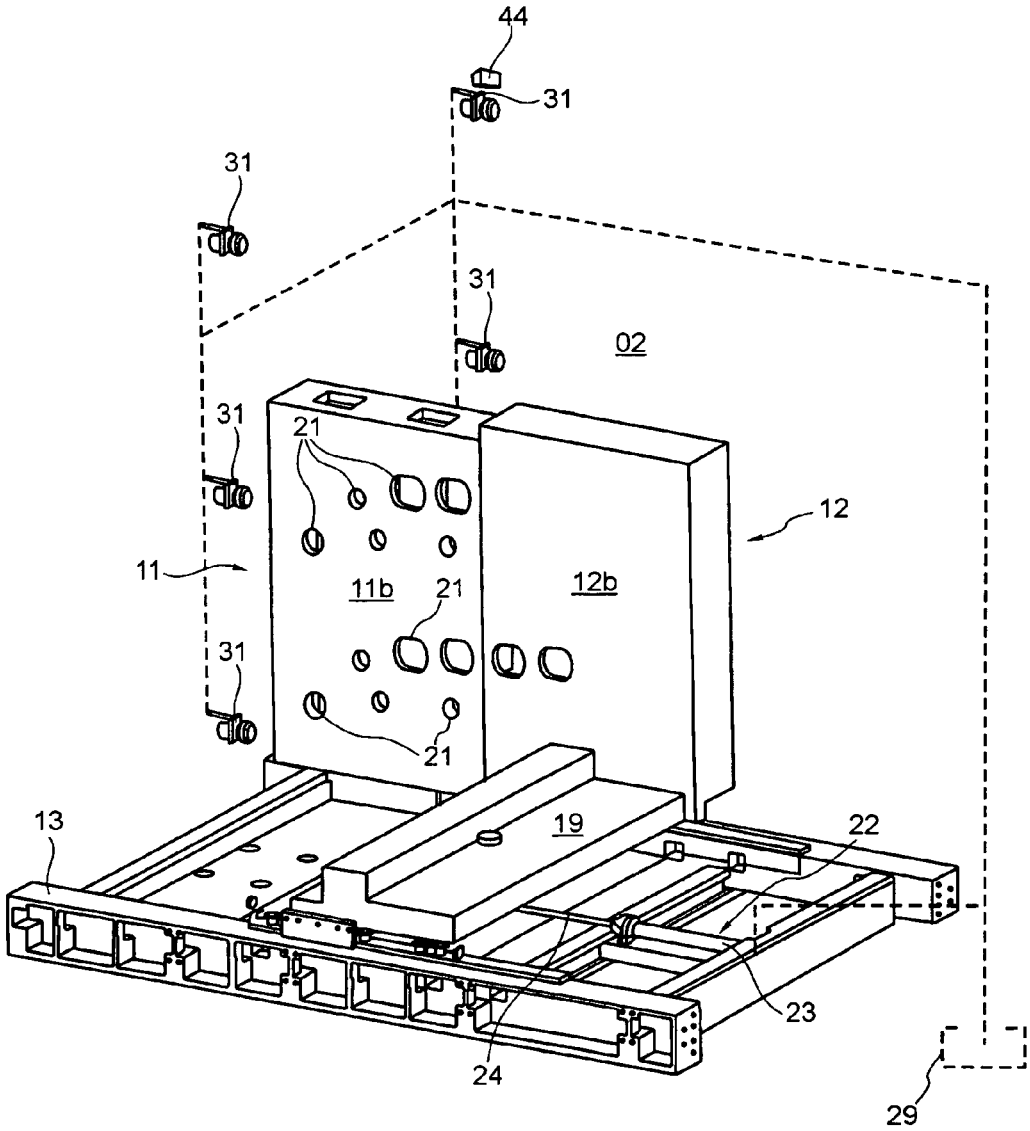
FIG. 2 is a perspective view of the frame of the printing unit of FIG. 1, wherein the side frame that faces the viewer is not shown.

As is especially apparent in FIG. 2, in which depiction, for purposes of clarity, the side frames that face the viewer are not shown, the frame 02 comprises the stationary side frame part 11, whose side frames that are opposite one another are fixed to the base 13, and the displaceably mounted side frame part 12, whose side frames that are opposite one another are displaceably mounted on the base 13. The two side frames of the displaceable side frame part 12 are rigidly connected to one another via a lower cross rail 19 which is arranged near the base 13 so as to enable shared movement of the two side frames of the displaceable side frame part or module 12.

Figure 3:
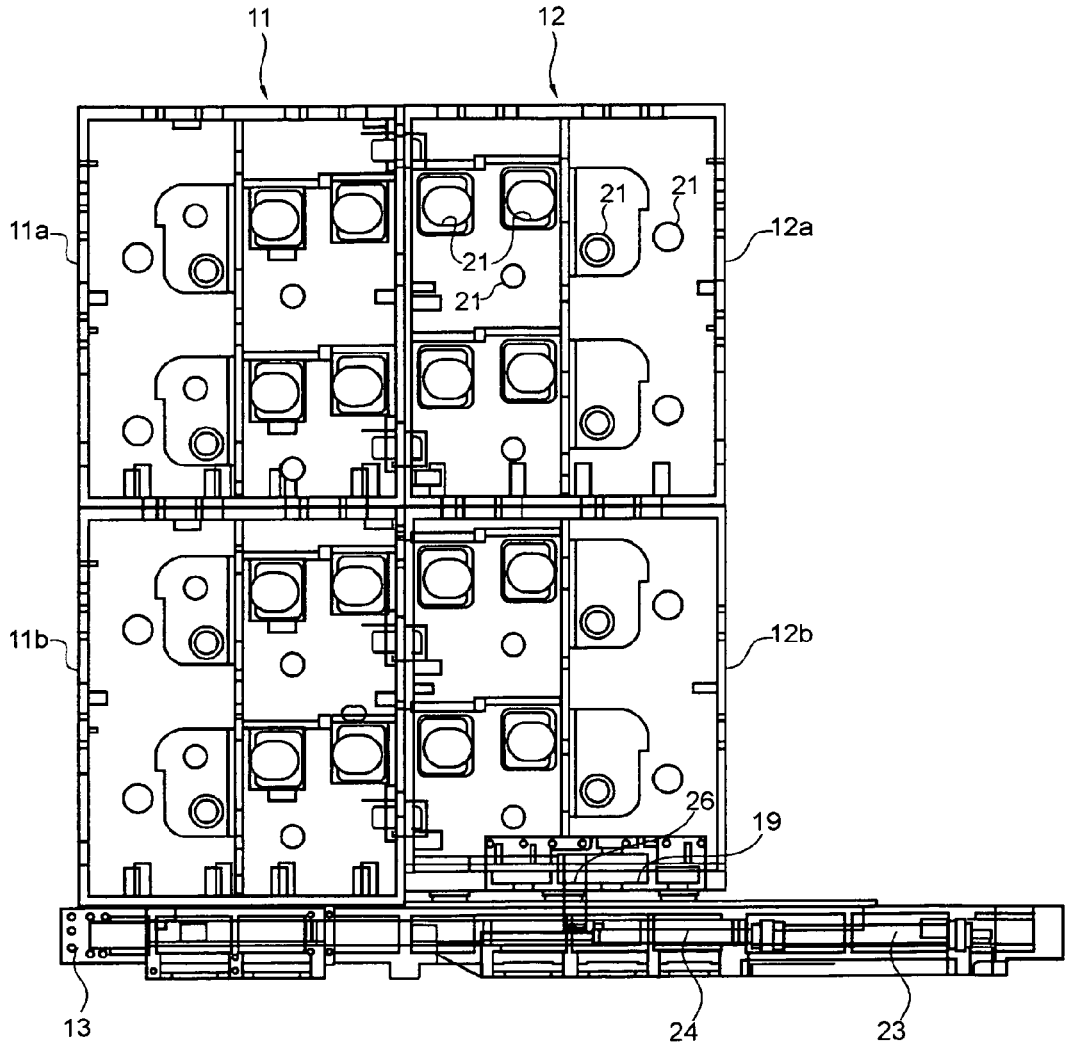
FIG. 3 is a side view of the frame of FIG. 2, and which also shows the horizontal separation of the frame.

As is shown in FIG. 3, at least one of the side frame parts or modules 11; 12, and preferably all or both such side frame parts or modules 11; 12, are each configured as being separable vertically, specifically, and especially along an essentially horizontal plane. In principle, and in particular, based upon the overall height of the respective printing tower, separation of each side frame into multiple parts is possible. In the case of the present configuration, a separation of each side frame into two pieces 11*a*; 11*b* and 12*a*; 12*b*, respectively, or into two side frame halves 11*a*; 11*b* and 12*a*, 12*b*, respectively, is provided. Such a separability would ordinarily be sufficient to ensure the intended problem-free, simple, and cost-saving transportability of the side frame halves 11*a*; 11*b*; 12*a*; 12*b*. Especially after accomplishment of their transport, the side frame halves 11*a*; 11*b* and 12*a*; 12*b*, respectively, can be securely fastened to one another, such as, for example, by being screwed to one another using threaded bolts, thereby forming the side frame parts or modules 11 and 12, respectively.

As is shown in FIG. 3, the side frame parts or modules 11; 12 are separated at least essentially at the center, thus resulting in at least essentially equal side frame halves 11*a*; 11*b*; 12*a*; 12*b* of at least essentially equal dimensions. This separation and sizing is advantageous, particularly in terms of structure and handling.

The individual side frame halves or pieces 11*a*; 11*b*; 12*a*; 12*b* are each configured at least essentially as box-shaped, each with its open side pointing toward the outside of the printing press 01, for example. The side frame halves 11*a*; 11*b*; 12*a*; 12*b* further have various openings 21 for use in accommodating bearing devices for the printing couple cylinders 06; 07 and also for accommodating peripheral apparatus of the individual printing couples 04, such as, for example, inking unit 08 and/or inking unit rollers, dampening unit 09 and/or dampening unit rollers and the like. They are configured such that, based upon the needs of the customer, they can be used for different formats, such as for example, using forme cylinder 07 and transfer cylinder 06 of different diameters.

To accomplish the horizontal movement or displacement of the side frame part or module 12, for facilitating its variable spacing, a preferably hydraulic cylinder/piston assembly 22 is provided. Assembly 22 including a cylinder 23, one end of which is attached to the base 13, and a piston rod 24, one end of which is attached to the movable side frame part 12. This hydraulic cylinder/piston assembly 22 is also depicted in FIG. 2, FIG. 3, FIG. 7, FIG. 8 and FIG. 15 through FIG. 17. The cylinder/piston assembly 22, as shown most clearly in FIG. 2, is preferably positioned on the bottom side of the movable side frame part 12. Specifically, the cylinder/piston assembly 22 is positioned so as to be at least essentially, and preferably precisely, centered with respect to, or, for example, at the center of the load which is supported between the oppositely arranged side frame parts 11; 12. The piston rod 24 is connected to a vertically extending bolt 26, as may be seen in FIG. 7, which vertically extending bolt 26 is, in turn, connected to the cross rail 19 of the side frame part 12, which cross rail 19 is not shown in FIG. 7.

Figure 8:
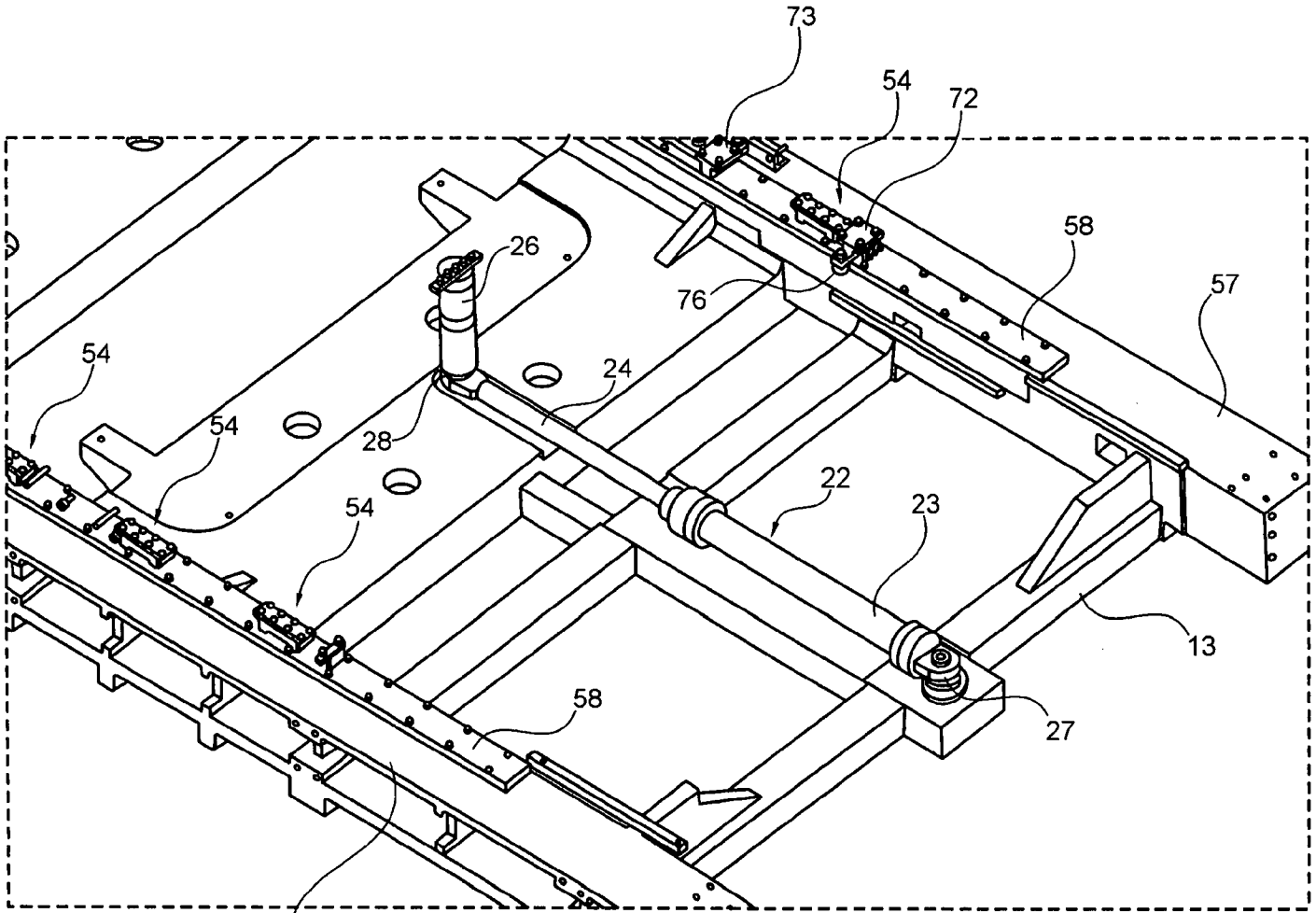
FIG. 8 is an enlarged representation according to FIG. 7, which, in particular, also shows the cylinder/piston assembly for moving the displaceable side frame part.

The cylinder 23 of the cylinder/piston assembly 22 is mounted at a first end, which is opposite to the end of the piston rod that is connected to the bolt 26, and namely at its right end in the illustration of FIG. 8, for example, on the base 13 by the utilization of a bearing device 27, and specifically by the utilization of a swivel bearing 27 with a vertically oriented swivel axis. The piston rod 24 is mounted at a second end, namely at the left end in the illustration of FIG. 8, on the movable side frame part 12 by the use of another bearing device 28, namely a swivel bearing 28, which is also configured with a vertically oriented swiveling axis. In the embodiment under discussion here, the piston rod 24 is connected, on its end remote from the cylinder 23, on the cross rail 19, and in particular, is connected on the bolt 26 which is fastened to the cross rail 19 of the moveable frame part or module 12.

As is depicted schematically in FIG. 2, for the operation of the cylinder/piston assembly 22, and for the operation of at least one additional hydraulic element, and in particular, a hydraulic unit of the printing unit 01, a shared hydraulic fluid supply 29 is provided. This shared hydraulic fluid supply 29 can also supply fluid to the actuators 16 or to the hydraulic pistons 16 of the bearing units 14 or to linear bearings 14. As depicted in FIG. 1, and/or the hydraulically actuable closure devices 31 and/or swivel tensioning elements 31, which are depicted in FIG. 2, and which will be described in what follows. Such closure devices 31 are usable for securing the side frame parts or modules 11; 12 in the closed, functional position. Finally, the shared hydraulic fluid supply 29 can also supply fluid to at least one additional pressure generating device of the printing unit 01, which is not specified in greater detail.

To fix the side frame parts or modules 11; 12 in their respective functional positions, such as, for example, in the position in which the printing unit 01 is in its production function, at least one such closure device 31 is provided. Preferably, at least one such closure device 31 is provided for each side of the frame 02, and specifically for each side frame part or module 11, 12. It is particularly preferable for at least two such closure devices 31 to be provided on each side, and especially for three such closure devices 31 to be provided on each side of each side frame part or module, as shown in FIG. 2. In a different printing format, it may be desirable to provide four such closure devices 31 per side. In this case, at least one closure device 31 is assigned to each side frame half 11*a*; 11*b*; 12*a*; 12*b*. In the illustrated preferred embodiment, which is shown in FIG. 2, the configuration is such that two closure devices 31 are assigned to each of the lower side frame halves 11*b*; 12*b* on either side of the printing unit 01, and one closure device 31 is assigned to each of the upper side frame halves 11*a*; 12*a*. In the case of multiple closure devices 31, these are preferably arranged vertically, one above the other.

Figure 6:
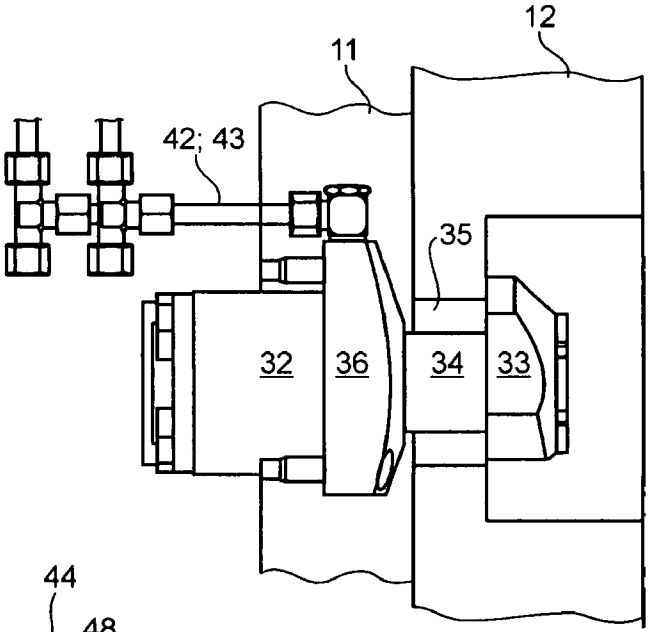
FIG. 6 is a side elevation view of the closure device of FIG. 4 or FIG. 5 with side frame parts in the functional position.
Figure 5:
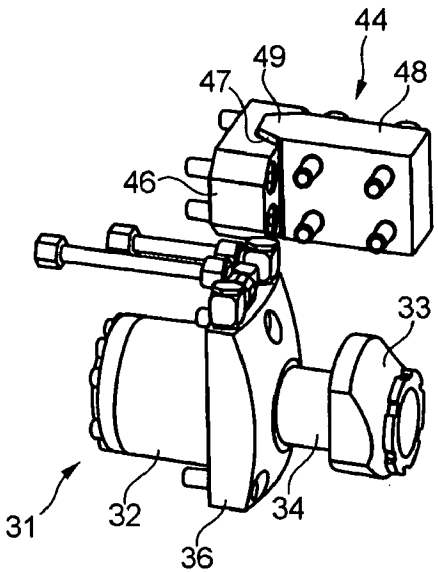
FIG. 5 is a further perspective representation of the closure device of FIG. 4, and a device for centering the two side frame parts in the functional position.
Figure 4:
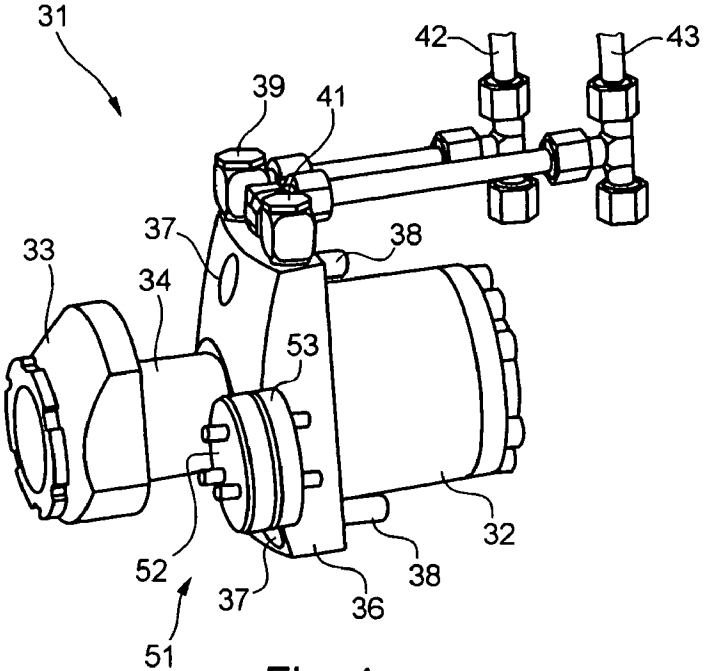
FIG. 4 is a perspective representation of a closure device for locking the side frame parts of the printing unit of FIG. 1 to FIG. 3, and a stop for securing the side frame parts in their functional position in accordance with the present invention.
Figure 7:
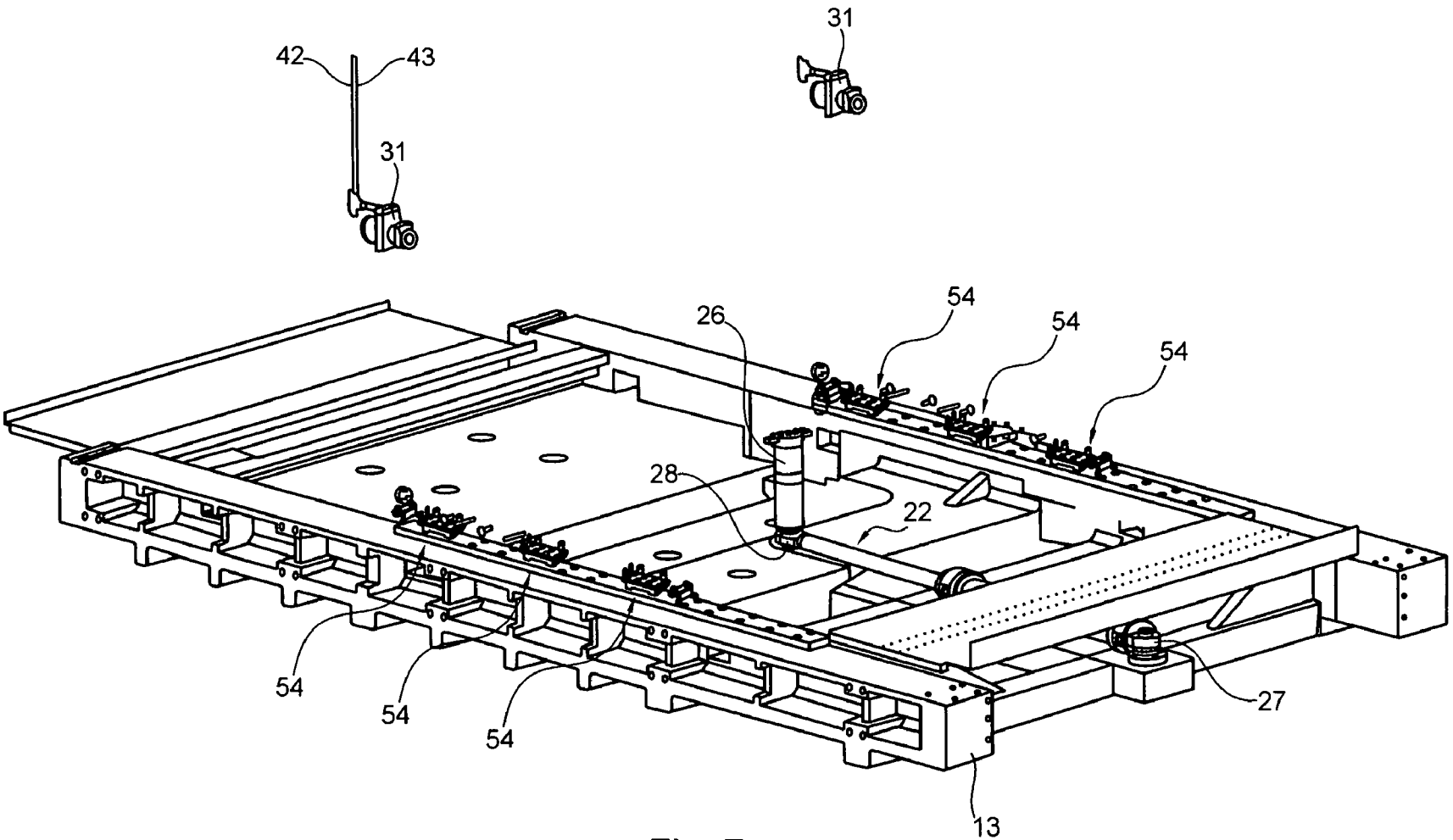
FIG. 7 is a perspective view of the base of the frame of the printing unit of FIG. 1 through FIG. 3, along with various components printing unit arranged on the base.

The structure of a preferred embodiment of a closure device 31, in accordance with the present invention, is illustrated, in particular, in FIG. 4 through FIG. 6. The closure device 31 preferably comprises a hydraulically actuable cylinder 32 which pretensions the assigned side frame parts or modules 11; 12 in the closed functional position, any in particular, comprises a tension cylinder 32 which pulls the side frame parts or modules 11; 12 into their functional position. Preferably, the closure device 31 comprises at least one swivelable chucking arm 33, which is capable of swiveling from a closed position to a released position, and which can be positioned at the unattached or free end of the piston rod 34 which slides into and out of the cylinder 32 of the closure device 31.

In particular, the swivelable chucking arm 33 can be rigidly connected to the free end of the piston rod 34 of the tension cylinder 32. The piston of the tension cylinder 32, and its piston, can be embodied as being rotatable about its longitudinal axis. The tension cylinder 32 is then expediently constructed in a known manner such that a part of the stroke of the piston in the tension cylinder 32 is used as a rotation stroke for rotating the piston and thus for swiveling the chucking arm 33. The closure device 31 is thus preferably embodied as a swivel tensioning element 31.

The closure device 31 further comprises a mounting flange 36, which is equipped with through holes or bores 37 with which the closure device 31 can be fastened to a side frame part or module 11; 12 or to a side frame half 11*a*; 11*b*; 12*a*; 12*b* by the use of suitable fasteners, such as screws 38. Preferably, the closure devices 31 or swivel tensioning elements 31 are mounted on the stationary side frame part 11, i.e., on the assigned side frame halves 11*a*; 11*b*, as seen, for example, in FIG. 6. On the side frame parts 12 that are opposite in the functional position, i.e., on the assigned side frame halves 12*a*; 12*b*, suitable openings 35 or holes 35 can then be formed. The swivel tensioning element 31 with its piston rod 34, also especially along with its chucking arm 33, can extend through an associated opening 35 in the as yet unfixed functional position. When the tension cylinder 32 is actuated, the chucking arm 33 is first swiveled until it engages behind the corresponding side frame part 11 or 12 or the corresponding side frame half 11*a*; 11*b*; 12*a*; 12*b*. As piston movement continues, the chucking arm 33, which has been swiveled into its tightened position, is increasingly pulled toward the cylinder 32, thereby pulling the movable side frame half 12*a*; 12*b* increasingly toward the stationary side frame half 11*a*; 11*b* and into its closed position or its functional position. Additionally, the large cylinder/piston assembly 22, which is located in the underframe, supports the precise positioning of the movable side frame part 12 during operation.

The openings 35 preferably each have a continuous, preferably endless, boundary. The openings 35 are preferably located in a wall that extends parallel to the rotational axes of the printing couple cylinders 06; 07. In particular, these openings 35 are located in the edge of the box-shaped side frame parts 11; 12 or side frame halves 11*a*; 11*b*; 12*a*; 12*b*), and preferably are located in the wall that faces the opposite side frame.

Ports 39; 41 for the supply and the removal of working medium, in particular, the hydraulic oil, which is supplied and removed to the hydraulic cylinder 32 via lines 42; 43, are also provided on the mounting flange 36 of the swivel tensioning element 31. The working fluid supply and discharge lines 42; 43, as described above, are connected to a shared hydraulic fluid supply 29, which also supplies fluid to the cylinder/piston assembly 22. All of the closure devices 31 can preferably be actuated together.

For use in laterally guiding and/or centering the side frame parts 11; 12 into their functional position, at least one centering device 44 is provided. This centering device 44, which is shown in FIG. 5, aligns the adjoining side frame parts 11; 12 in relation to one another. In the embodiment depicted in FIG. 5, the centering device 44 is embodied as a V-block device 44, which comprises a receiving piece 46 with a V-shaped receiving opening 47. This receiving piece 46 is preferably secured on one side frame part 11; 12, such as for example, on the stationary side frame part 11. An insertion piece 48, with a V-shaped insertion nose 49, is preferably secured on the other side frame part 11; 12, such as, for example, on the displaceable side frame part 12. The V-shapes of the receiving piece 46 and of the insertion piece 48 correspond with, and are complementary to one another.

As is shown schematically in FIG. 2, the centering device 44 is provided on only one side of the printing unit 01. It is arranged on the upper end sections of the side frame parts 11; 12 that face one another. It may be situated above the uppermost closure device 31 or may be situated below the lowermost closure device 31.

Figure 10:
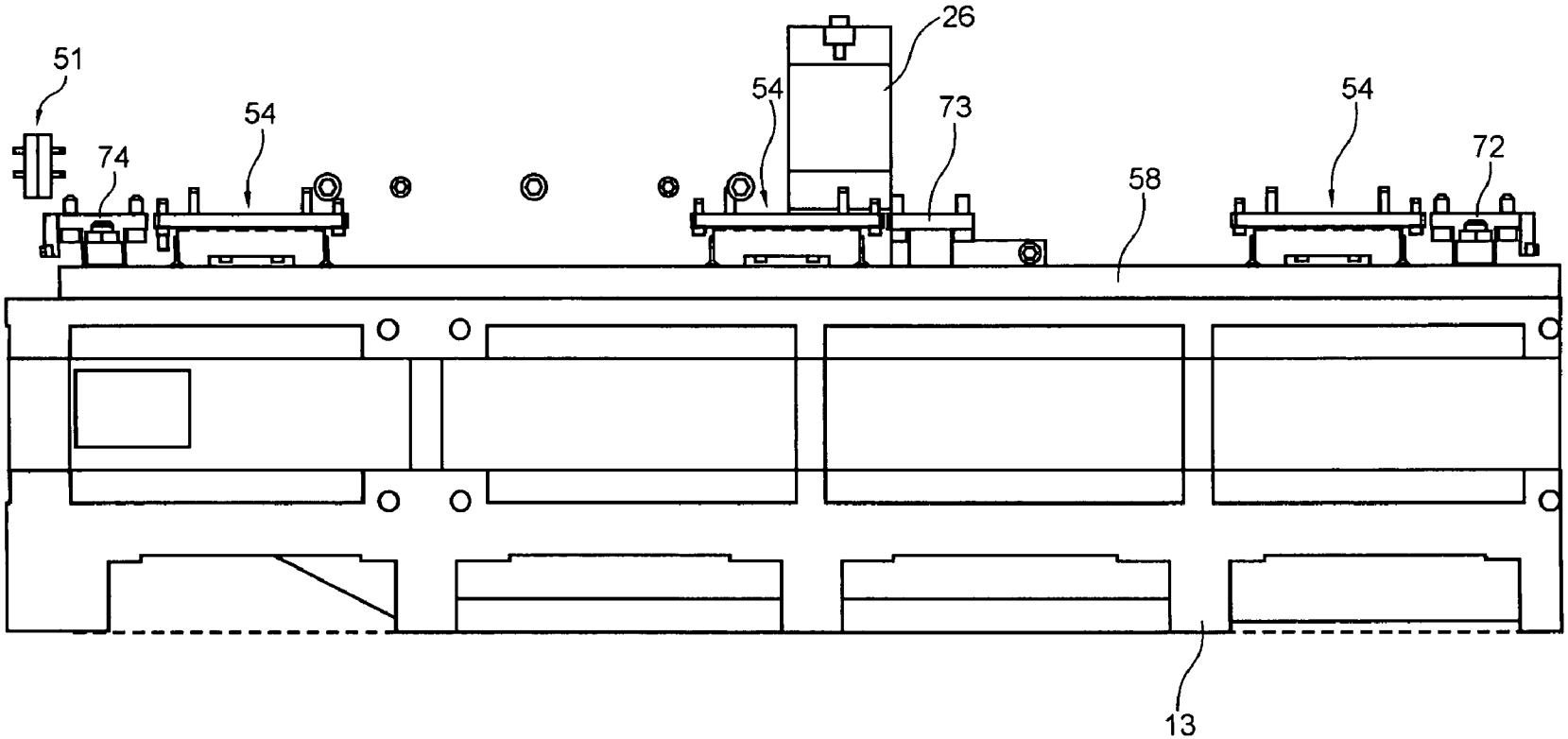
FIG. 10 is a side elevation view of the configuration of FIG. 9

In addition, for use in defining the functional position of the two side frame parts 11; 12, at least one stop device 51, which defines such a functional position, is provided, as may be seen, for example, in FIG. 4 or in FIG. 10. Preferably, multiple stop devices 51 are provided. In particular, stop devices 51 are provided on both sides of the printing unit 01, such as, for example, on the side frame parts 11; 12 of both sides of the printing unit 01. In particular, multiple stop devices 51 can be provided on each side of the printing unit 01. For example, two such stop devices 51 can be located on each printing unit side, or three or four stop devices 51 can be located on each side, based upon the format to be printed. Each closure device 31 can preferably be assigned a stop device 51, with each such closure device 31 preferably being assigned to its stop device 51 such that the respective stop device 51 is positioned directly adjoining the respectively assigned closure device 31.

Each stop device 51 can, as is shown most clearly in FIG. 4, comprise two disk-shaped stop elements 52; 53, for example, having surfaces that face one another and that define the stop surfaces. One stop surface is fastened to the side frame part 11 and the other stop surface is fastened to the side frame part 12, for example by the use of suitable fasteners, such as screws which are not specifically shown. Each stop device 51 can be embodied as being adaptable or adjustable, with respect to its precise stop position. This can be accomplished, for example, in a manner which is not specified in greater detail, by inserting different numbers of spacers and/or spacers of different thicknesses at the points of attachment of each stop position 52; 53 to its side frame part or module 11; 12.

Figure 9:
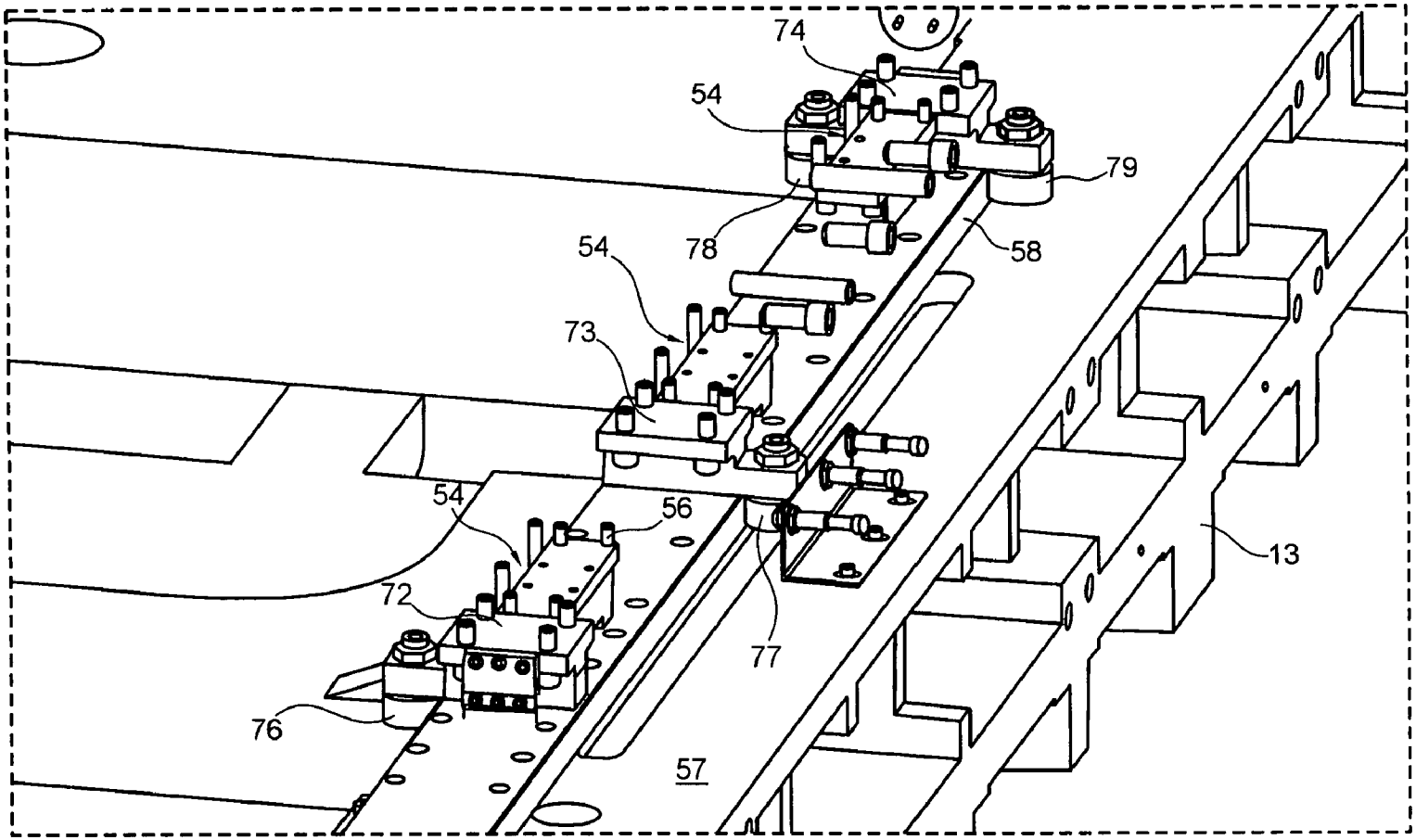
FIG. 9 is a detailed view of the base of FIG. 7 taken from a different direction and showing, in particular, a partial view of the guidance track of the movable side frame part by the use of running blocks.

To accomplish a displaceable mounting of the at least one displaceable side frame part or module 12 of the frame 02 of the printing unit 01 or of the printing tower 01, on each side of the printing unit 01, at least one running block assembly 54 is provided, as may be seen, for example, in FIG. 7 through FIG. 14. In the embodiment shown, for example in FIG. 7, three running block assemblies 54 are provided on each side of the printing unit 01. Each running block assembly 54 can be fastened with screws 56, for example, as depicted in FIG. 9, on the respective underside of the two opposite side frame parts or the respectively lower side frame half 12*b* of the displaceable side frame part 12. Opposite each of the running block assemblies 54, on the two lateral supports 57 of the base 13, guide rails 58 are mounted. The running block assemblies 54 run on these guide rails 58, which, at the same time, serve to laterally guide or to adjust the movable side frame part 12 as will be described further below.

Figure 11:
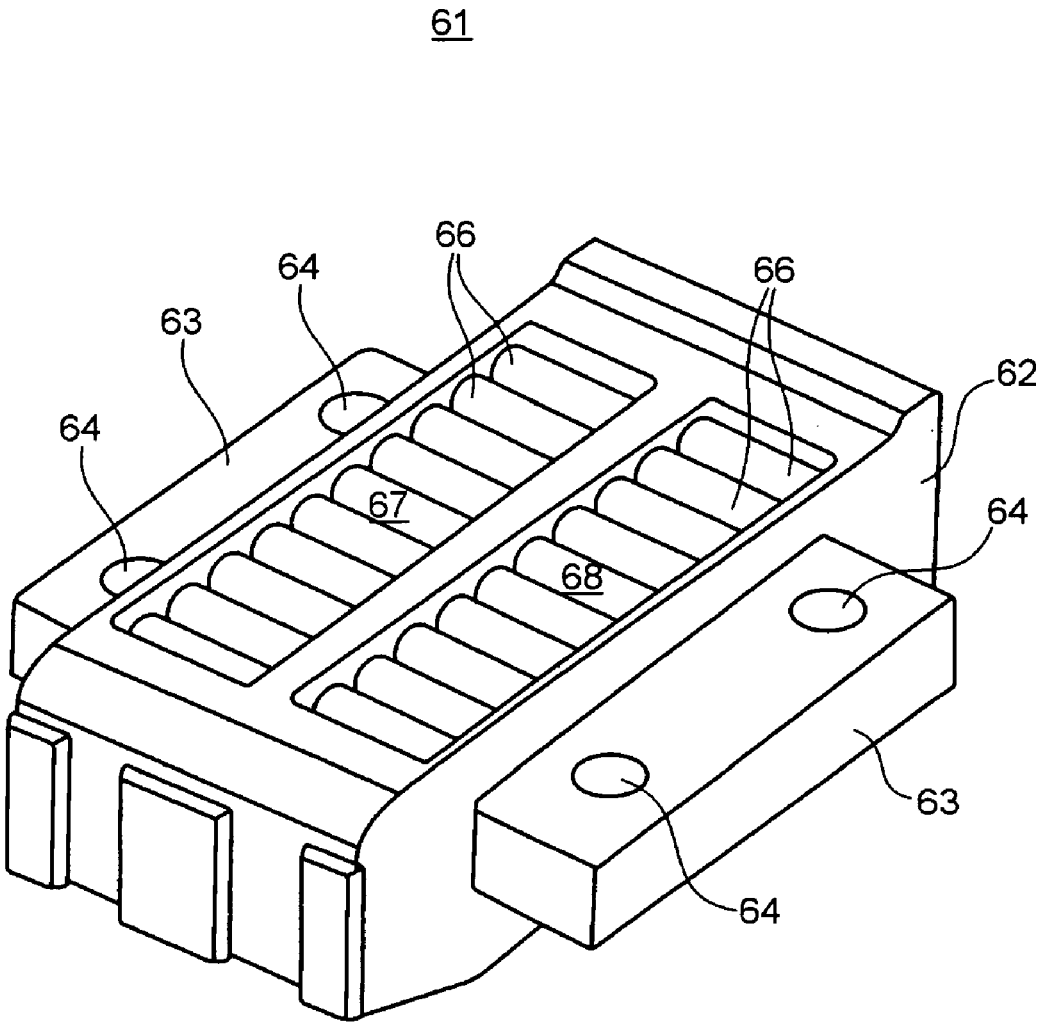
FIG. 11 is a perspective view of a running block from the bottom, with a guidance track according to FIG. 9 or FIG. 10.
Figure 12:
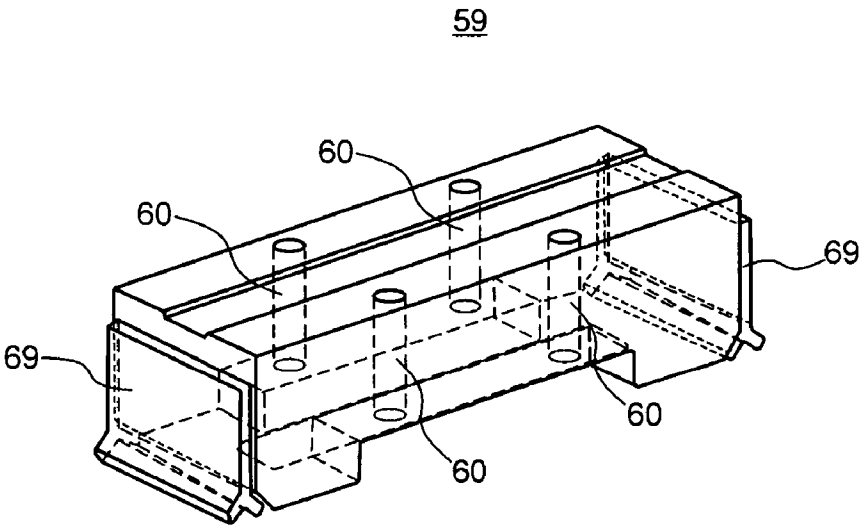
FIG. 12 is a perspective view of a running block support with a guidance track according to FIG. 9 or FIG. 10.
Figure 14:
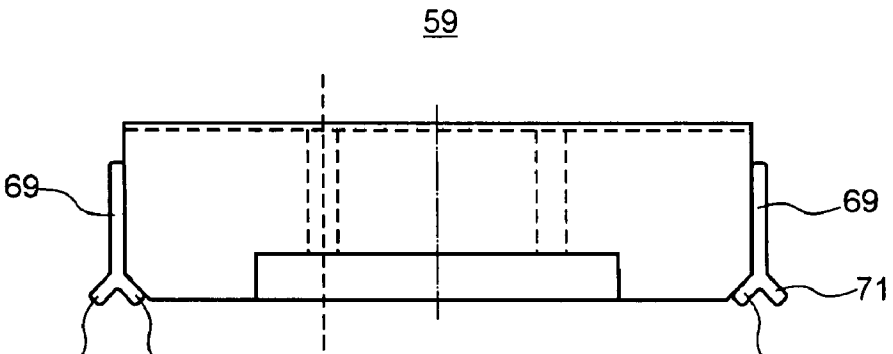
FIG. 14 is an additional view of the running block support of FIG. 13.
Figure 13:
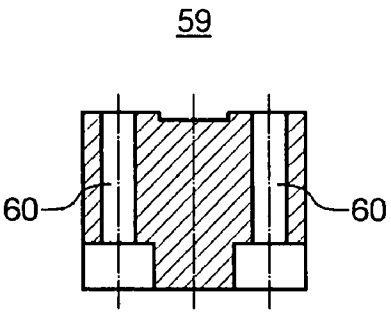
FIG. 13 is a cross-sectional view of the running block support of FIG. 12.
Figure 15:
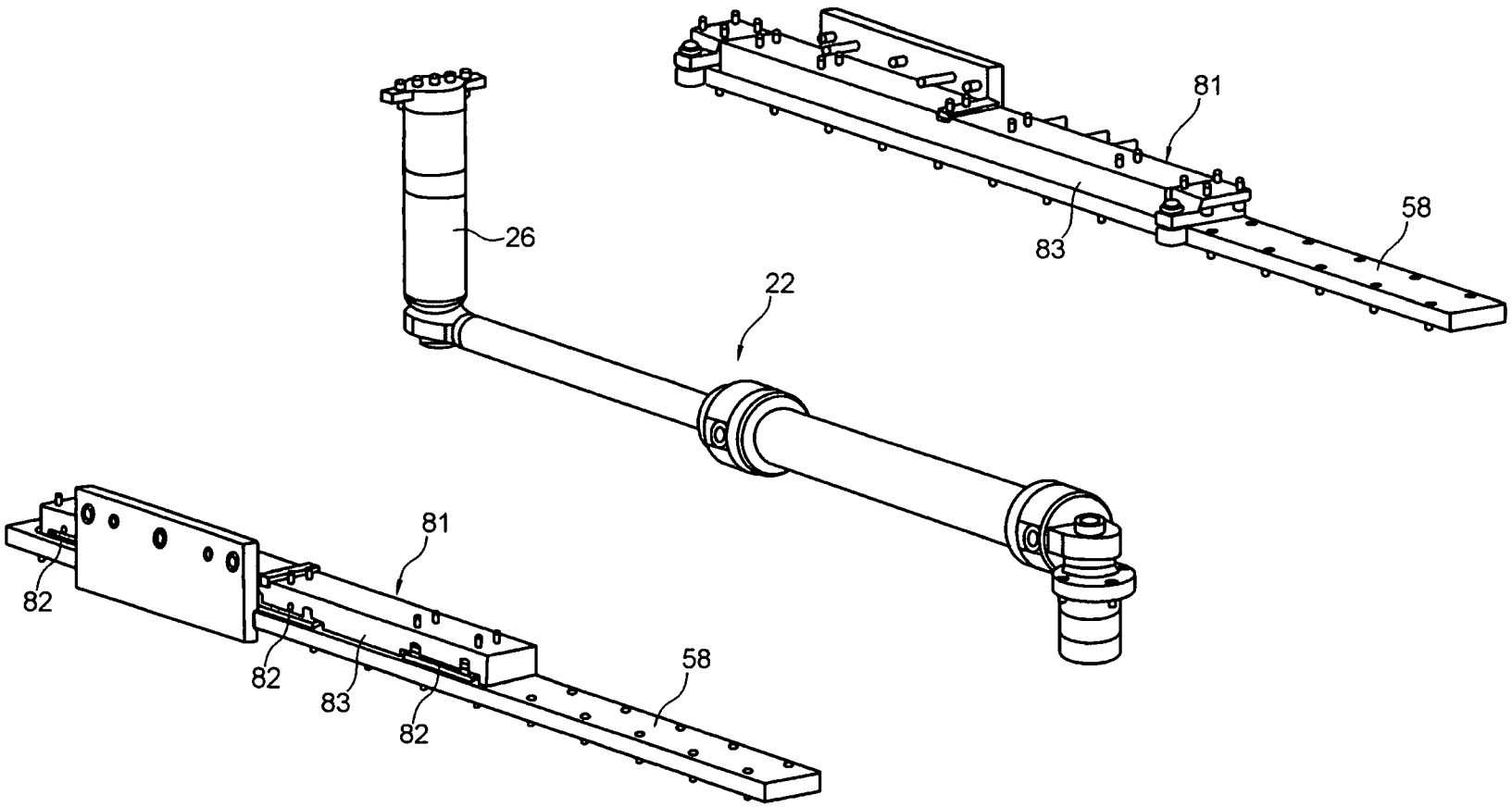
FIG. 15 is a perspective partial view of an alternative embodiment of a guidance track for the movable side frame part by the use of sliding block assemblies.

Each running block assembly 54 is comprised of an overall, approximately rectangular running block support 59, as may be seen, in particular, in FIG. 12 through FIG. 14. Each such running block support 59 can be fastened to the underside of the respective side frame part 12 via through holes or bores 60, and which running block supports 59 accommodates a running block 61, as is shown most clearly in FIG. 11. The running block 61 comprises a running block housing 62, on the sides of which are formed two fixed projections 63. These projections are formed with through holes 64 for use in fastening on the running block support 59 on the underside of the side frame part 12.

In the housing 62 of the running block 61, a plurality of rollers 66 are arranged in parallel. These rollers 66 are mounted to rotate around at least one closed track, arranged in a vertical plane which extends in the direction of movement of the displaceable side frame part 12, as the running block 61 moves. As is clear in the depiction shown in FIG. 11, multiple parallel tracks for multiple groups of rotating rollers 66 can be provided in each running block 61. Particularly as shown in FIG. 11, two parallel tracks, for two groups 67; 68 of rotating rollers 66, are arranged side by side. The closed track can be defined, for example, in a manner which is not specified in greater detail here, by two guide grooves located in the running block housing 62 opposite one another, in which two guide grooves, axle journals of the rollers 66 are guided.

The housing 62 of the running block 61 is open on its underside that faces the guide rail 58. The guide track for the rollers 66 is linear or flat in this area, thereby allowing the rollers 66 to come into contact with the guide rail 58 on their underside, and on their opposite, upper side, to be supported against a corresponding support surface which is formed in the housing 62 and which is not specified in greater detail. When the displaceable side frame part 12 moves, the components of the running block 61 and the guide rail 58 roll against one another in the manner of a roller bearing.

At least one stripper device 69 is assigned to each running block assembly 54, and is arranged upstream of the rollers 66 of the running block 61. Each such stripper device 69 is usable to scrape any soiling off of the surface of the guide rail 58 as the running block 61 moves, thereby keeping soiling away from the running block 61. Preferably, two stripper devices 69 are provided on each running block assembly 54, with one such stripper device 69 being arranged upstream of the running block 61 in each of the two directions of travel of the running block 61.

A stripper device 69 can be arranged on the running block assembly 54, for example, on each of the front and rear sides of the rectangular running block support 59, as viewed in the direction of travel of the running block assembly 54, as seen in FIG. 14. In this case, the stripper device 69 can be embodied as a stripper seal 69, and can consist, for example, of flexibly deformable material with at least one stripper lip 71 which is arranged in the travel plane of the rollers 66. For a particularly effective seal, in the preferred embodiment, each such stripper device 69 has two stripper lips 71, such as, for example, two such sealing lips 71, which are arranged one in front of the other, as viewed in the direction of travel of the running block 61.

In addition to the above-described running block assemblies 54, guide roller supports 72; 73; 74 are also fastened on the underside of at least one of the two displaceable side frame parts 12 that are opposite one another, or may be fastened to both displaceable side frame parts 12 that are opposite one another. Such guide roller supports 72; 73; 74 are preferably situated only on the one side frame part 12 that supports the centering device 44. These guide roller supports are optionally embodied as being adjustable with respect to their position. Guide rollers 76; 77; 78; 79, having vertically arranged rotational axes are mounted on these guide roller supports, and are supported on both sides of the guide rail 58 on its narrow side. These guide rollers 76; 77; 78; 79 enable a guiding or an adjustment of the movably mounted side frame part 12. Guide roller support 72 supports a guide roller 76 arranged on the inside, guide roller support 73 supports a guide roller 77 arranged on the outside, and guide roller support 74 supports both a guide roller 78 arranged on the inside and a guide roller 79 arranged on the outside, all as seen most clearly in FIG. 9.

An alternative type of mounting, which will now be described, is an alternative to the above-described mounting of the displaceable side frame part 12 using running blocks 61. A mounting of the displaceable side fame part 12 on sliding blocks 82, and using this alternative type of mounting, will be described in what follows in reference to FIG. 15 to FIG. 22.

To accomplish the displaceable mounting of the at least one displaceable side frame part or module 12 of the frame 02 of the printing unit 01 or of the printing tower 01, a sliding block assembly 81 may be provided on each side of the printing unit 01. Each such sliding block assembly 81 comprises at least one sliding block 82 having a sliding surface 88, which is preferably made of plastic. In the illustrated embodiment shown in FIG. 15, on each side of the printing unit 01, three sliding blocks 82 are provided, for example, which three sliding blocks 82 are held in a shared sliding block support 83. This shared sliding block support 83 can be fastened on the respective underside of the two side frame parts that are opposite one another, or can be secured on the respective lower side frame half 12*b* of the displaceable side frame part 12, by the use of screws 84, for example. The sliding surface 88 can also be screwed on or glued on directly to the displaceable side frame part 12. Opposite the sliding block assembly 81, guide rails 58 are fastened on the two lateral supports 57 of the base 13, along which guide rails 58 the sliding block assemblies 81 run and which guide rails 58 also serve, at the same time, for the lateral guidance and/or for the adjustment of the movable side frame part 12, as will be described further subsequently.

Figure 16:
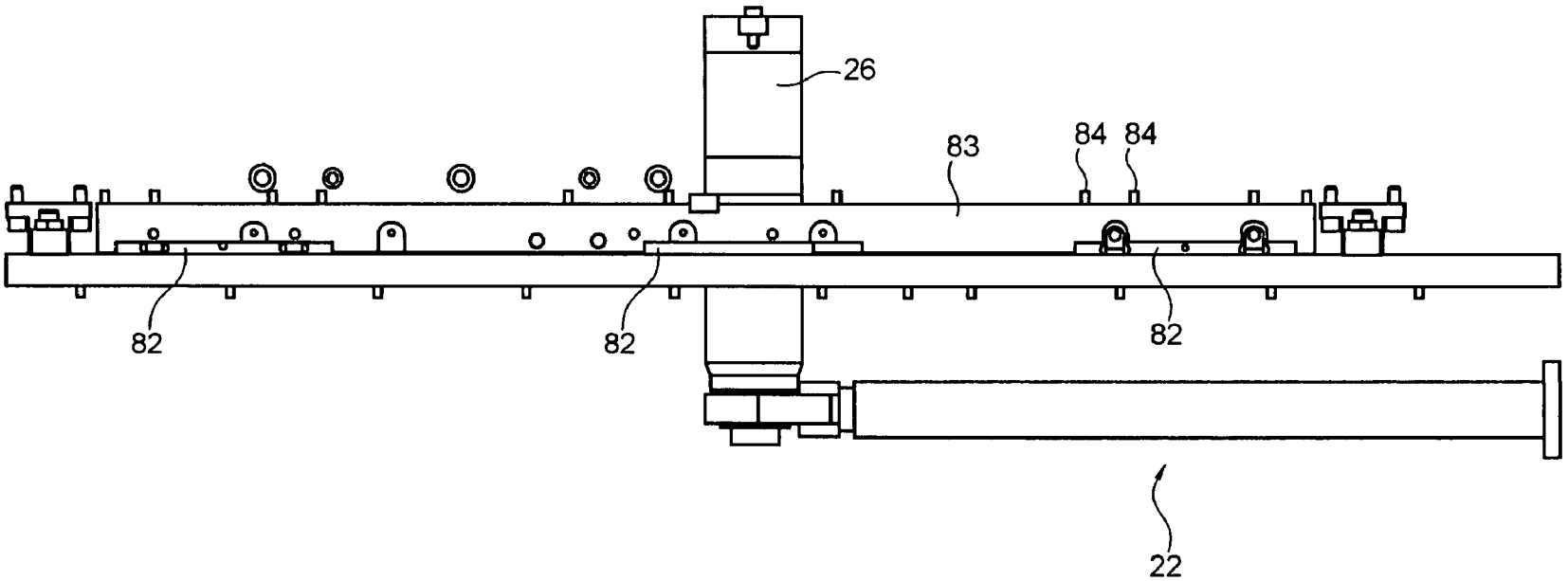
FIG. 16 is a side view of the representation of FIG. 15.
Figure 17:
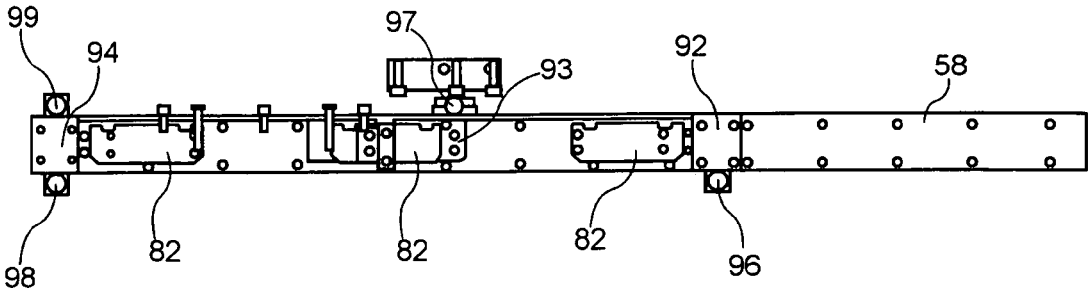
FIG. 17 is a plan view of the representation similar to FIG. 15, but without sliding block supports.
Figure 17:
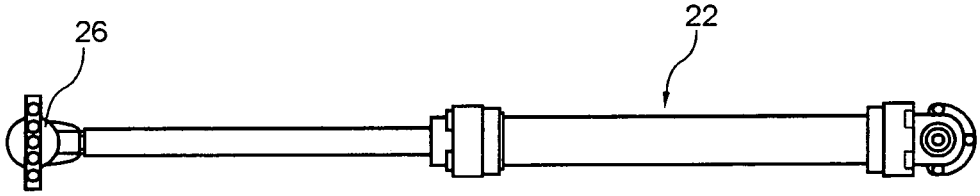
Figure 17:
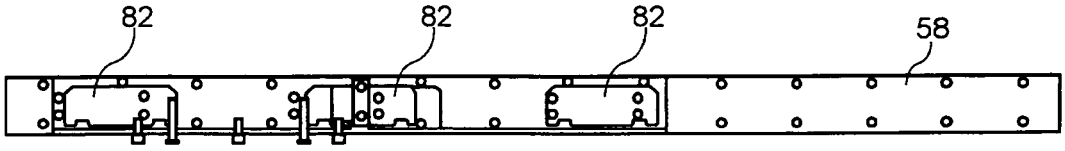
Figure 18:
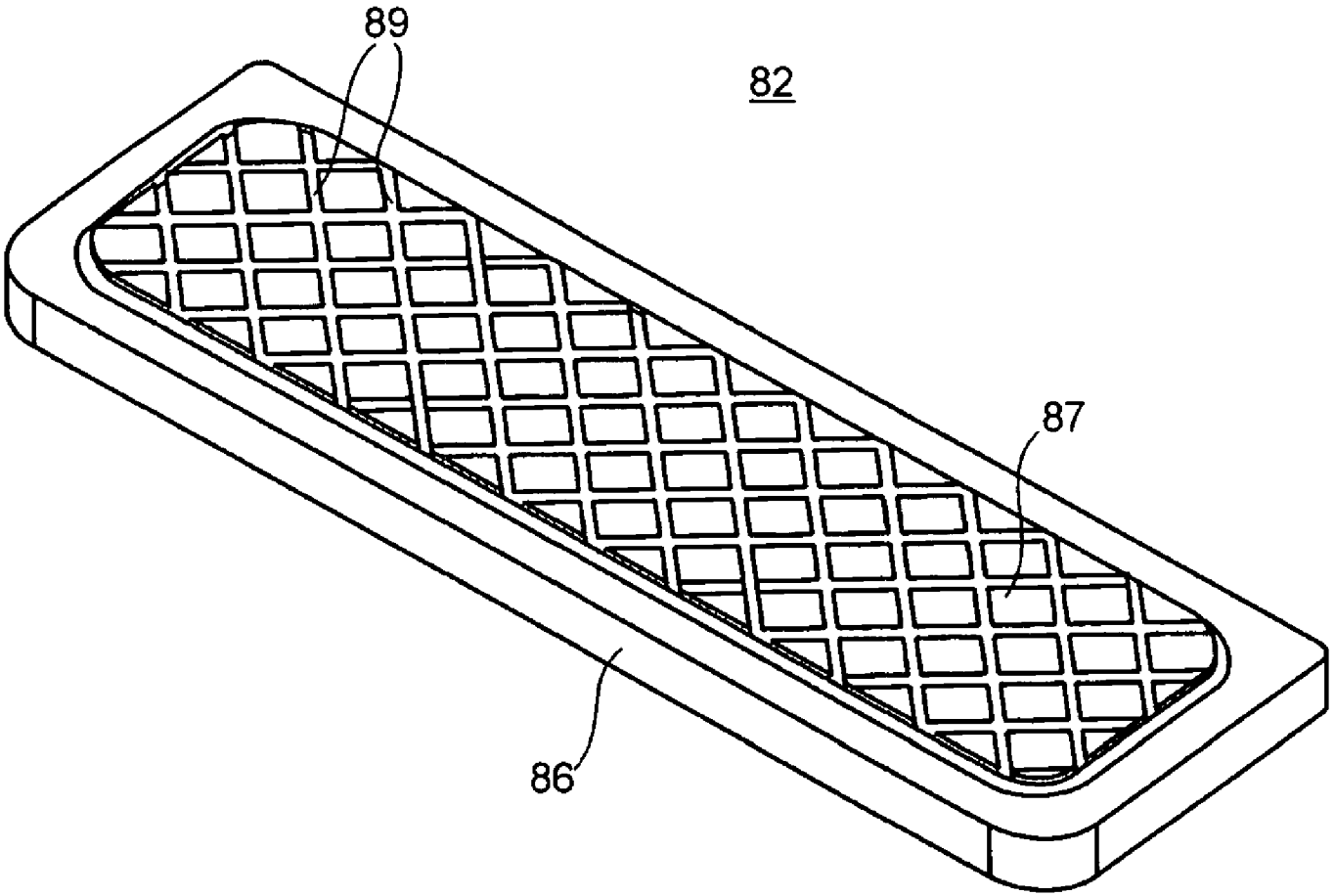
FIG. 18 is a perspective view of a sliding block of a sliding block assembly of FIG. 15.
Figure 20:
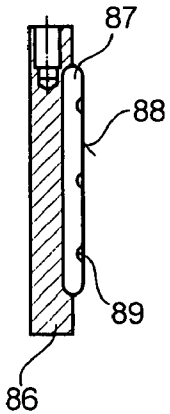
FIG. 20 is a cross-sectional view of the sliding block of FIG. 19.

Each sliding block 82 is held in a recess in the sliding block support 83, as seen in FIG. 15*a* and FIG. 16. Each such recess in the sliding block support 83 is shaped to correspond to the shape of the sliding block 82, and, as is shown, in particular, in FIG. 18 through FIG. 22, is embodied as being at least approximately plate shaped. Each sliding block 82 has a sliding block base 86 and a sliding layer 87, which sliding block layer 87 defines the sliding surface 88 and which sliding block layer 87 is fastened on the sliding block base 86, such as, for example, by being glued, and, in particular, is made of plastic with low frictional properties. The sliding surface 88 of the sliding block 82, which faces downward in its use position, projects downward beyond the underside of the sliding block support 83 when the sliding block 82 is installed. Only the sliding blocks 82, and not the sliding block support 81, come into contact with the surface of the guide rail 58.

A suitable plastic with low frictional properties that may be used as the material for the sliding layer 87 preferably has a friction coefficient of between 0.02 and 0.40, with a surface pressure of between 1.0 and 4.0 N/mm2 and a temperature of 25° C. More specifically, the plastic has a friction coefficient of between 0.04 and 0.30, with a surface pressure of between 0.5 and 4.0 N/mm2 and a temperature of 25° C. In particular, the plastic preferably has a friction coefficient of between 0.06 and 0.12, with a surface pressure of between 0.3 and 4.7 N/mm2 and a temperature of 25° C. It is further preferable for the plastic material to have a tensile strength of between 30 and 100 N/mm2, and in particular, to have a tensile strength between 45 and 75 N/mm2. Finally, a preferable plastic material with low frictional properties has a deterioration factor, at 20° C., of less than 0.2 mm/100 km, preferably has a deterioration factor at 20° C. of less than 0.1 mm/100 km, and in particular, preferably has a deterioration factor at 20° C. of less than 0.05 mm/100 km.

A material that is suitable for use as the plastic material for the sliding layer 87 can especially be a structural plastic, which can preferably be embodied as a composite plastic comprising multiple materials. Such a plastic material should preferably be maintenance-free and wear-resistant. Preferably, the plastic comprises one component of thermoplastic polyester, while another component has a rubber-like character with high elasticity. A suitable material is generally known and is commercially available under the name ZEDEX, and in this case especially under the name ZX-100, preferably ZX-100A, or, in particular, Uniform 2000 gray-blue, which material possesses the preferably desirable properties to a high degree.

Figure 19:
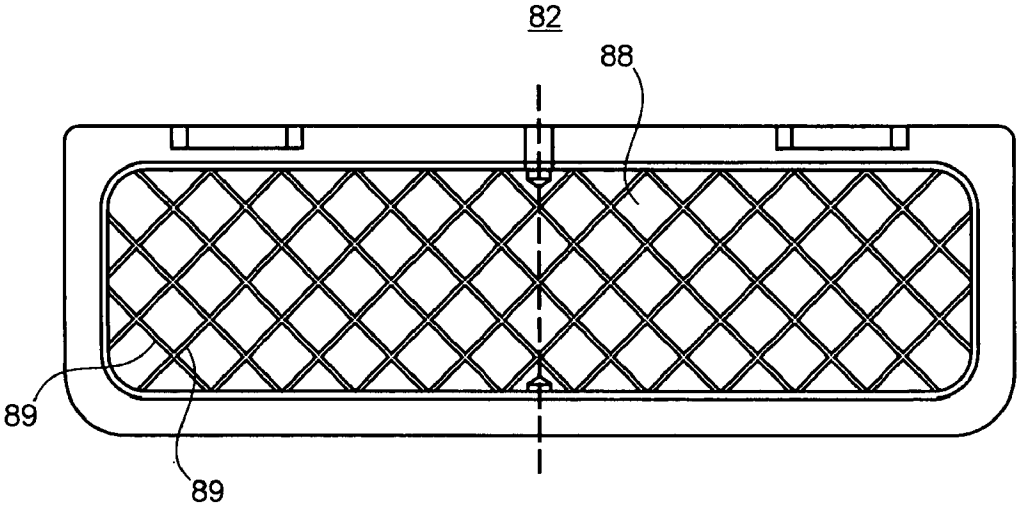
FIG. 19 is a top plan view of the sliding block of FIG. 18.
Figure 21:
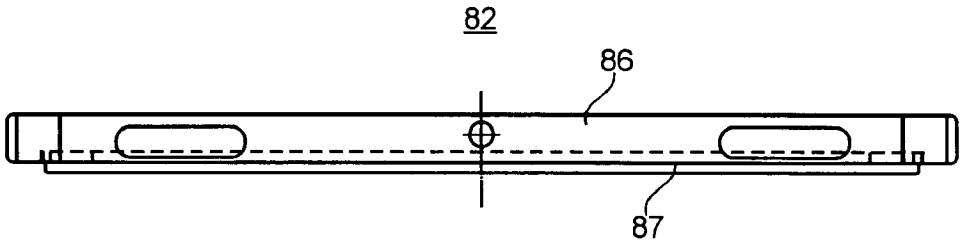
FIG. 21 is an additional side view of the sliding block of FIG. 19.
Figure 22:
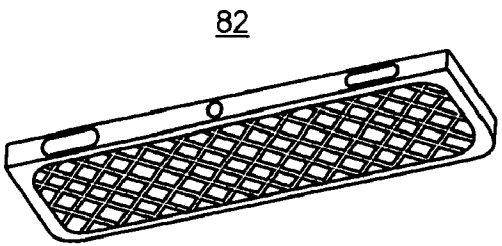
FIG. 22 is a perspective view of the sliding block of FIG. 19, as viewed from the bottom.

Each of the sliding blocks 82 can have a sliding surface 88 of between 20 and 1,000 cm2, for example, preferably can have a sliding surface 88 between 40 and 400 cm2, and, in particular, can have such a sliding surface 88 of 100 cm2+/−50%. In the sliding surface 88, depressions 89, which are usable for holding soiling, can be formed. These depressions 89 act to prevent wear and tear and to limit a decrease in sliding capacity of the sliding surface 88 caused by soiling, to the greatest possible extent. The depressions 89 can especially be embodied as grooves or flutes, and, as shown in FIGS. 18, 19, 20 and 22, can cover the sliding surface 88 generally in the form of a net. In particular, the longitudinal extension of the depressions 89 can run at an angle to a direction of displacement of the movable side frame part 12, so as to enable an automatic emptying of the depressions 89, for example. In particular, these depressions 89 form an angle of 45° with the direction of displacement of the movable side frame part 12. It is particularly preferable for the sliding surface 88 to have a grid of intersecting, groove-shaped depressions 89, which depressions 89 run at an angle to the direction of displacement of the side frame part 12, as shown in FIG. 19, for example.

It is preferable for the depressions 89 of the sliding surface 88 to have a relatively large surface ratio of more than 10% of the sliding surface 88, preferably to have a ratio of more than 20%, and in particular, to have a surface ratio of between 25% and 35% of the sliding surface 88. In the case of the preferred embodiment, a surface ratio of 30%+/−3%, for example, of the sliding surface 88 is preferable.

To accomplish the lateral guidance or adjustment of the movable side frame part 12, guide roller supports 92; 93; 94 as seen in FIG. 17*a*, and which are optionally embodied as being adjustable, with respect to their position, are attached to the underside of one or both of the displaceable side frame parts 12. These guide roller supports 92; 93; 94 are preferably attached on only the side frame part 12 that supports the centering device 44. Guide rollers 96; 97; 98; 99 are mounted on these guide roller supports 92; 93; 94, respectively, with their rotational axes being arranged vertically, and being positioned and supported on both sides of the guide rail 58 on their narrow side, thereby enabling a guidance or an adjustment of the movably mounted side frame part 12. Guide roller support 92 supports a single guide roller 96 arranged on the inside of guide rail 58. Guide roller support 93 supports a single guide roller 97 arranged on the outside of guide rail 58. Guide roller support 94 supports both a guide roller 98 arranged on the inside of guide rail 58 and a guide roller 99 arranged on the outside of guide roller 58.

While preferred embodiments of a printing unit comprising at least two side frame parts whose distance relative to each other can be modified in a horizontal direction have been described fully and completely herein above, it will be apparent to one of skill in the art that changes to, for example, the specific structure of the printing groups, the numbers of printing groups in each printing unit, the source of the pressurizing fluid and the like could be made without departing from the true spirit and scope of the present invention which is accordingly to be limited only by the appended claims.

What is claimed is:

1. A printing unit comprising:

at least a first side frame part and a second side frame part, a spacing distance between said first side frame part and said second side frame part, relative to each other, being adjustable in a horizontal direction of displacement by movement of at least one of said first side frame part and said second side frame part, relative to the other of said at least first side frame part and said second side frame part in said horizontal direction of displacement;

at least one of a printing couple and a part of a printing couple accommodated on each of said first and second side frame parts;

a mounting supporting said movable one of said at least first and second side frame parts for movement in said direction of displacement between a closed functional position, in which said first and second side frame parts are moved together and are fixed relative to each other, and an open position in which said at least first and second side frame parts are spaced from one another in said direction of displacement;

at least one sliding surface in said mounting and supporting said movable one of said at least first and second side frame parts, said at least one sliding surface being a composite plastic comprised of multiple materials including a thermoplastic polyester component; and a plurality of depressions in said at least one sliding surface, said plurality of depressions being capable of holding soil.

2. The printing unit of claim 1, further including a sliding block including said at least one sliding surface made of said composite plastic.

3. The printing unit of claim 2, wherein said sliding block includes a sliding block base and a sliding layer attached to said sliding block base.

4. The printing unit of claim 3, said sliding layer is made of plastic.

5. The printing unit of claim 1, wherein said composite plastic has a friction coefficient between 0.02 and 0.40 with a surface pressure of between 1.0 and 4.0 N/mm$^2$ and a temperature of 25° C.

6. The printing unit of claim 5, wherein said composite plastic has a friction coefficient between 0.04 and 0.30 with a surface pressure of between 0.5 and 4.0 N/mm$^2$ and a temperature of 25° C.

7. The printing unit of claim 6, wherein said composite plastic has a friction coefficient between 0.06 and 0.12 with a surface pressure of between 0.3 and 4.7 N/mm$^2$ and a temperature of 25° C.

8. The printing unit of claim 1, wherein said composite plastic has a tensile strength of between 30 and 100 N/mm$^2$.

9. The printing unit of claim 1, wherein said composite plastic has a wear factor at 20° C. of less than 0.2 mm/100 Km.

10. The printing unit of claim 9, wherein said composite plastic has a wear factor at 20° C. of less than 0.1 mm/100 Km.

11. The printing unit of claim 9, wherein said composite plastic has a wear factor at 20° C. of less than 0.05 mm/100 Km.

12. The printing unit of claim 1, wherein said composite plastic is a structural plastic.

13. The printing unit of claim 1, wherein said composite plastic includes a component having a rubber-like character with high elasticity.

14. The printing unit of claim 1, wherein said at least one sliding surface has a sliding surface area of between 20 and 1,000 $cm^2$.

15. The printing unit of claim 14, wherein said at least one sliding surface has a sliding surface area of between 40 and 400 $cm^2$.

16. The printing unit of claim 15, wherein said at least one sliding surface has a sliding surface area of 100 $cm^2 \pm 50\%$.

17. The printing unit of claim 1, wherein said movable side frame part has first and second spacing side frame halves that are opposite to each other and that at least one sliding surface is secured on each of said first and second side frame halves.

18. The printing unit of claim 1, wherein each said movable side frame part has at least two of said sliding surfaces spaced apart from each other.

19. The printing unit of claim 1, wherein said plurality of depressions are ones of grooves and flutes.

20. The printing unit of claim 1, wherein said plurality of depressions cover said sliding surface in the form of a net.

21. The printing unit of claim 2, wherein said displaceably mounted side frame part has an undersurface and further wherein said at least one sliding block is positioned on said undersurface.

22. The printing unit of claim 2, further including at least two of said sliding blocks assigned to each said movable side frame part.

23. The printing unit of claim 20, wherein there are three of said sliding blocks on each said movable side frame part.

24. The printing unit of claim 1, wherein said displaceably moveable side frame part has an undersurface and further wherein said three sliding blocks are positioned on said undersurface.

25. The printing unit of claim 1, wherein said plurality of depressions occupy a surface ratio of more than 10% of said at least one sliding surface.

26. The printing unit of claim 25, wherein said plurality of depressions occupy a surface ratio of more than 20% of said at least one sliding surface.

27. The printing unit of claim 26, wherein said plurality of depressions occupy a surface ratio of between 25% and 35% of said at least one sliding surface.

28. The printing unit of claim 27, wherein said plurality of depressions occupy a surface ratio of 30%±3% of said at least one sliding surface.

29. The printing unit of claim 1, including a base for said printing unit and having spaced lateral supports and further including guide rails on said spaced lateral supports, said at least one sliding surface contacting said guide rails.

30. The printing unit of claim 29, further including at least one guide roller support having guide rollers mounted on said guide roller support for rotation about a vertical guide roller axis of rotation, with at least one guide roller support laterally guiding said at least one displaceable side frame part on said guide rails.

31. The printing unit of claim 30, wherein said guide rollers are arranged on first and second sides of said guide rail.

32. The printing unit of claim 1, wherein there is one first side frame part and one second side frame part.

33. The printing unit of claim 1, wherein one of said at least first and second side frame parts is stationary.

34. The printing unit of claim 33, wherein one of said side frame parts is displaceable with respect to said one stationary side frame part.

35. The printing unit of claim 1, wherein said printing unit is a printing tower.

36. The printing unit of claim 1, further including a plurality of said printing couples mounted one above the other in said printing unit.

37. The printing unit of claim 36, wherein said plurality of said printing couples are blanket-to-blanket printing couples including transfer cylinders.

38. The printing unit of claim 37, wherein said printing unit is separable along a plane of contact of said transfer cylinders on each of said blanket-to-blanket printing couples.

39. The printing unit of claim 1, further including at least four of said printing couples arranged one above the other in each side frame part.

40. The printing unit of claim 1, wherein each printing unit is a printing tower with four blanket-to-blanket printing units arranged one above the other and further wherein one of said side frame parts is stationary and another of said side frame parts is movable.

41. A printing unit comprising:

at least a first side frame part and a second side frame part, a spacing distance between said first side frame part and said second side frame part, relative to each other, being adjustable in a horizontal direction of displacement by movement of at least one of said first side frame part and said second side frame part, relative to the other of said at least first side frame part and said second side frame part in said horizontal direction of displacement:

at least one of a printing couple and a part of a printing couple accommodated on each of said first and second side frame parts;

a mounting supporting said movable one of said at least first and second side frame parts for movement in said direction of displacement between a closed functional position, in which said first and second side frame parts are moved together and are fixed relative to each other, and an open position in which said at least first and second side frame parts are spaced from one another in said direction of displacement;

at least one sliding surface in said mounting and supporting said movable one of said at least first and second side frame parts, said at least one sliding surface being a composite plastic comprised of multiple materials: and a plurality of depressions in said at least one sliding surface, said plurality of depressions extending in a longitudinal direction at an angle with respect to said direction, of displacement and being capable of holding soil.

42. The printing unit of claim 41, wherein said displaceable side frame part is movable in a said direction of displacement and further whereon said sliding surface has a grid of intersecting ones of grooves and flutes forming said plurality of depressions.

43. The printing unit of claim 41, wherein said plurality of depressions form an angle of 45' with respect to said direction of displacement.

* * * * *